United States Patent [19]

Straitz, III

[11] 4,198,198

[45] Apr. 15, 1980

[54] FLARES FOR WASTE GAS DISPOSAL

[75] Inventor: John F. Straitz, III, Meadowbrook, Pa.

[73] Assignee: Combustion Unlimited Incorporated, Jenkintown, Pa.

[21] Appl. No.: 863,138

[22] Filed: Dec. 22, 1977

[51] Int. Cl.[2] ..... F23J 15/00; F23D 11/00

[52] U.S. Cl. ..... 431/202; 138/32; 138/105; 165/45; 431/5

[58] Field of Search ..... 431/202, 5; 138/38, 138/105; 165/45, 135; 250/506, 515

[56] References Cited

U.S. PATENT DOCUMENTS

| | | | |
|---|---|---|---|
| 1,041,256 | 10/1912 | Elkin | 138/32 |
| 1,758,474 | 5/1930 | Seehaus | 219/365 |
| 2,189,466 | 2/1940 | Huth | 138/32 |
| 3,703,349 | 11/1972 | Straitz | 431/202 |
| 3,749,546 | 7/1973 | Reed et al. | 431/202 |
| 3,774,403 | 11/1973 | Cushing | 138/105 |
| 3,822,983 | 7/1974 | Proctor et al. | 431/5 |
| 3,840,035 | 10/1974 | Lefever | 165/45 |
| 3,932,111 | 1/1976 | Liknes et al. | 431/202 |
| 4,065,248 | 12/1977 | Straitz et al. | 138/105 |

*Primary Examiner*—James C. Yeung
*Assistant Examiner*—Daniel J. O'Connor
*Attorney, Agent, or Firm*—Zachary T. Wobensmith, 2nd; Zachary T. Wobensmith, III

[57] ABSTRACT

A flare for waste gas disposal by combustion is disclosed particularly suited for use in remote areas such as deserts, where space is not limited and in which the portions of the flare exposed to radiation are of heat resistant material, the remainder of the flare and its supply connections being covered for protection against deleterious radiation effects thereon, provisions being made for protection of the waste gas supply line, pilot gas supply line and the ignitor supply line to minimize problems of expansion and contraction and to avoid erosion of the protective provisions.

14 Claims, 3 Drawing Figures

FLARES FOR WASTE GAS DISPOSAL

BACKGROUND OF THE INVENTION

1. Field of the Invention

This invention relates to flares for waste gas disposal by combustion.

2. Description of the Prior Art

It has heretofore been proposed for disposal of waste combustible gas from oil refineries and the like to employ flares in desert areas and the like, often identified as miniflares, of a height of the order of thirty feet, the upper section (approximately twelve feet in height) consisting of a heat resistant alloy flare tip supported on a carbon steel molecular seal, such as is shown in my prior U.S. Pat. No. 3,685,534 of a height of the order of eighteen feet, and to which the waste gas is delivered by an exposed flare header. The direct radiation from the flame and the reflection of the radiation from the ground has a destructive effect on components which are not resistant to the heat and on personnel too close to the flare. This is further aggravated by deflection of the flame by occasional or prevailing winds.

Problems have also arisen with flares of this character heretofore available and in which liquid carryover burns on the surface of the ground near the flare.

The flare of the present invention is not subject to and overcomes the objectionable features of flares for comparable use which have heretofore been employed.

SUMMARY OF THE INVENTION

In accordance with the invention a flare is provided which is particularly suited for use in desert areas and the like in which the exposed portions of the flare are of material which is resistant to the radiant heat from the combustion of the waste gas, the remaining portions, including the waste gas supply conduit, the pilot gas supply pipes and the ignitor supply pipes referably being enclosed within a conduit which is in turn covered by sand, or the like, preferably protected against erosion.

It is the principal object of the invention to provide a flare in which the problems of thermal radiation are eliminated, likelihood of backfiring is avoided, which is lower in cost and which eliminates expansion and contraction problems.

It is a further object of the invention to provide a flare of the character aforesaid which minimizes problems of combustible liquid carryover.

It is a further object of the invention to provide a flare of the character aforesaid which employs readily available materials.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
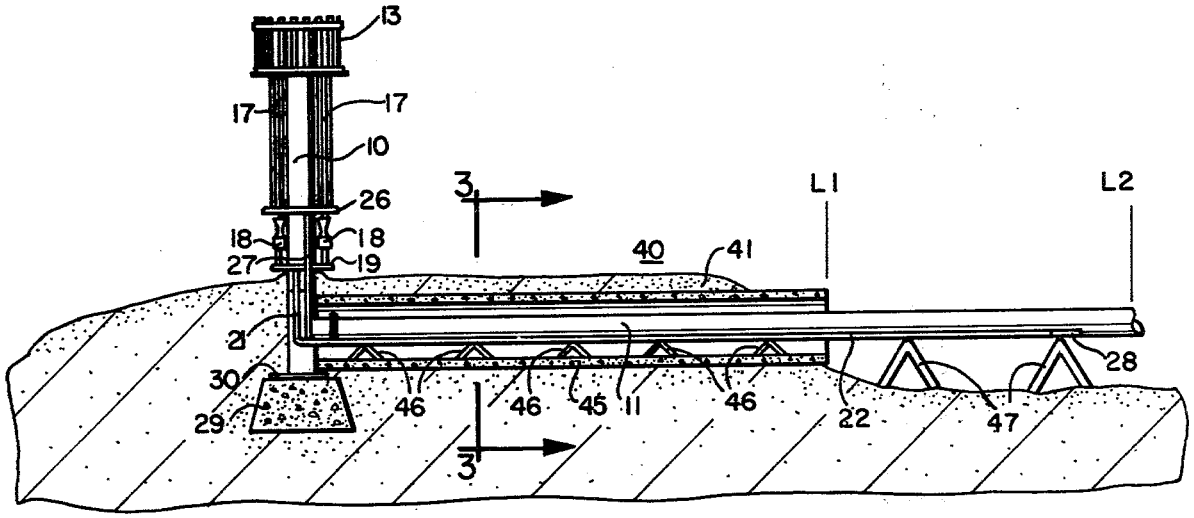
FIG. 1 is a view in elevation of a flare in accordance with the invention, parts being broken away to show the details of construction.
Figure 3:
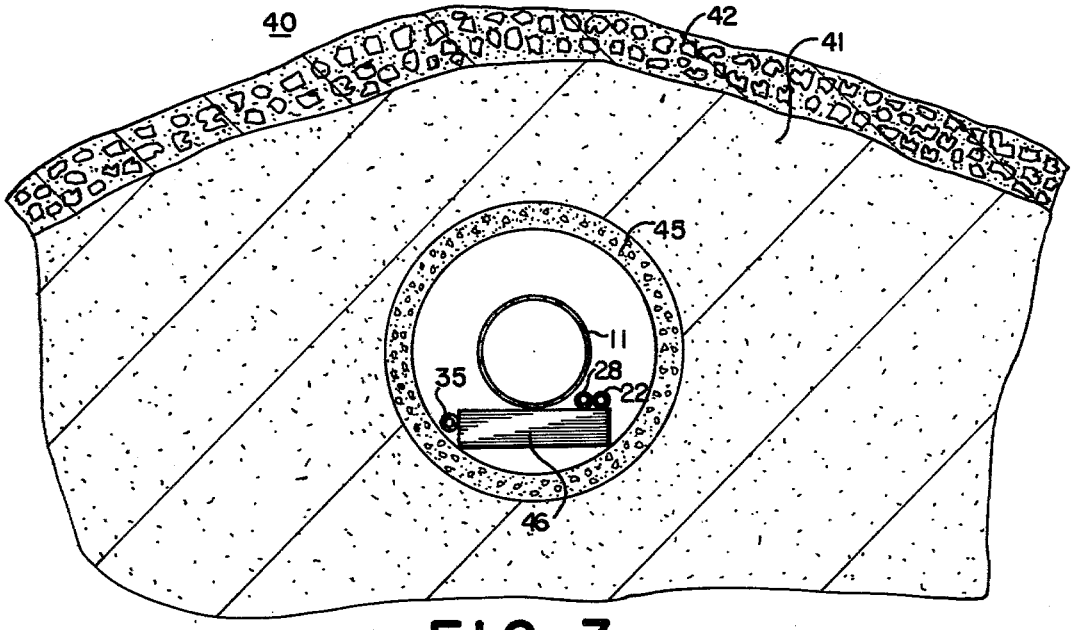
FIG. 3 is a transverse sectional view, enlarged, taken approximately on the line 3—3 of FIG. 1.
Figure 2:
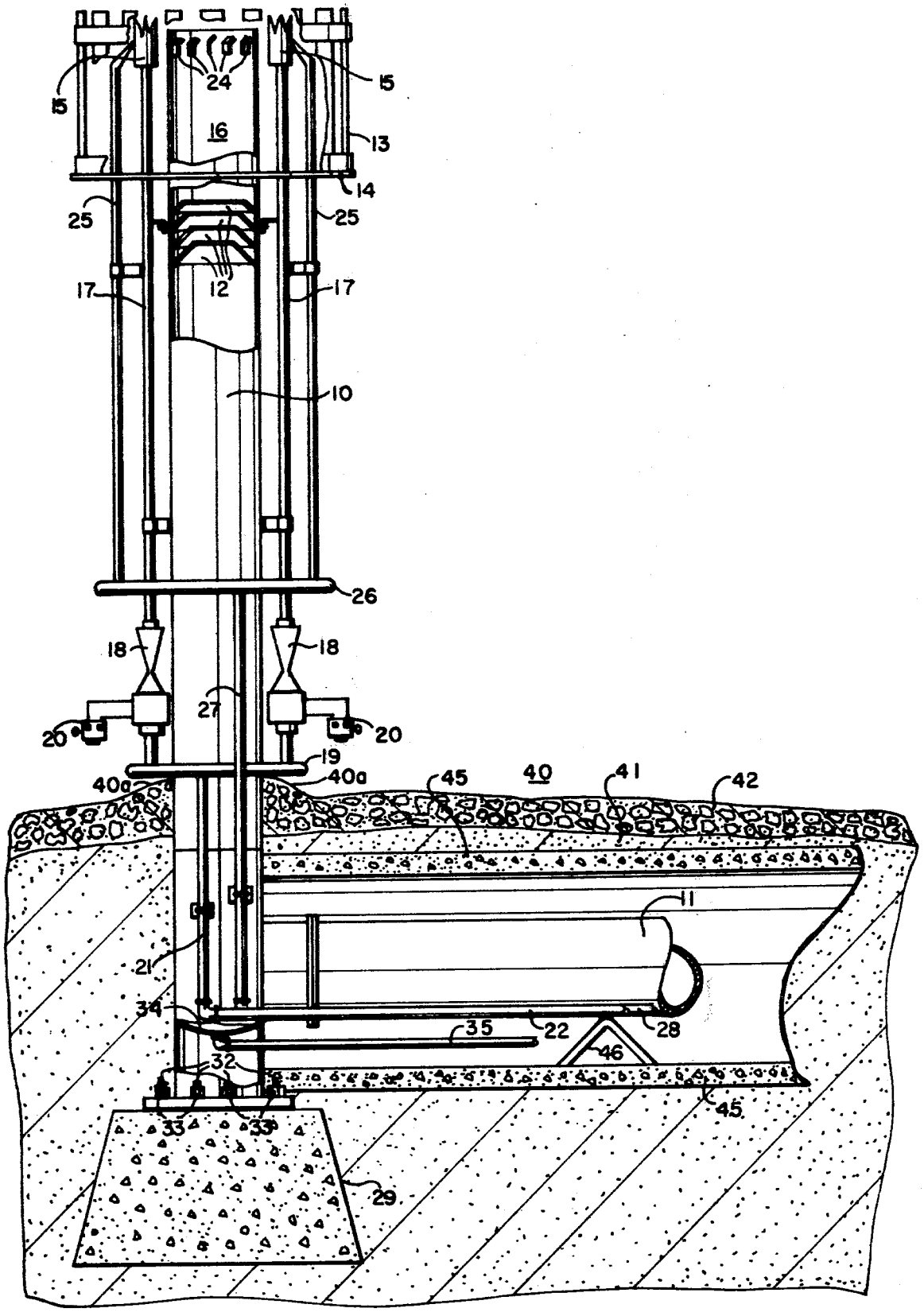
FIG. 2 is an enlarged view showing the flare stack and related structure.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, in which a preferred embodiment of the invention is illustrated, a flare stack 10 is shown having a horizontal supply conduit 11 connected thereto for the supply of waste combustible gas for combustion. The flare stack 10 may be inclined but is preferably vertically disposed. The flare stack 10 preferably has a fluidic diode or seal 12 spaced downwardly from the top to permit free upward movement of gas but to provide a substantial obstacle to downflow in the stack 10. A suitable seal for this purpose is shown in my U.S. Pat. No. 3,730,673. A flame retainer of any desired type is preferably provided at the tip of the flare stack 10 and can have a plurality of vanes 24 as shown in my application for U.S. Patent filed July 13, 1977, Ser. No. 815,100.

The flare stack 10 preferably has a hollow cylindrical slotted windshield 13, closed at the bottom by a floor 14, to protect the ignitor pilots 15 and burner end 16 of the stack 10 from the wind.

The number of pilots 15 will be determined by the diameter of the stack 10, two being shown in this embodiment.

Each of the pilots 15 has a pilot gas supply pipe 17 extending thereto, supported by the stack 10, connected to venturi 18 to which pilot gas is supplied from a pilot gas ring 19. Air is drawn in by each of the venturis 18 through a screen 20 which prevents the inflow of dirt or sand.

A combustible pilot gas supply pipe 21 is connected to the ring 19 and has a horizontal portion 22 which extends along the pipe 11, as hereinafter explained.

In order to ignite the pilots 15, pilot ignitor pipes 25 are provided, supported by the pipes 17, and connected to an ignitor divider ring 26. The ring 26 has an ignitor supply pipe 27 connected thereto for the supply in a well known manner of a flame front for delivery to the pilots 15 to ignite the gas-air mixture supplied thereto. The pipe 27 has a horizontal portion 28 which extends along the pipe 11, as hereinafter explained.

The flare stack 10 can be supported in any desired manner and for this purpose may have a bottom flange 30 secured to a base 29 of concrete or the like by studs 32 and nuts 33.

At the bottom of the stack 10 a partition 34 can be provided having a drain pipe 35 extending therefrom for draining any liquid at the bottom of the stack 10.

A mound 40 having a peak **40*a* is provided from which the flare stack 10 extends upwardly from approximately the level of the ring 19. The mound 40 can be of any suitable material 41 such as dirt or sand, which is available at the location where the stack 10 is placed. If dirt or sand is used for the mound 40** there is a tendency for the wind, particularly in desert areas, for the same to blow away. Dirt has lower reflectivity and lower heat conductivity and is preferred but is also susceptible to being readily washed or blown away. Sand can be packed or compacted but has high heat reflectivity and thermal conductivity. The thickness of the protective layer of dirt or sand is of the order of one foot and depends on gas flow rate, gas composition, flame length and flame as tilted by the wind. Gravel packs poorly and by reason of the air spaces has low heat conductivity.

It is preferred, in order to prevent erosion, to cover a mound of sand or dirt with a cover layer 42 of gravel, such as crushed stone of 1½ to 2 inch size, or of broken firebrick of a size of 2 to 3 inches, such layer 42 typically being of a thickness of the order of three or four inches, the firebrick having similar characteristics to that of the gravel.

The stack 10, the windshield 13, the pilots 15 and the associated piping and accessories, exposed above the top of the mound 40, are preferably made of thermally resistant metal such as stainless steel. The horizontal pipes 11, 22, 28 and 35 by reason of the protection by the mound can be made of carbon steel.

At the bottom of the flare stack pipe 10, and covered by the mound 40, a pipe 45 preferably of concrete and of the type employed as soil or drainage pipe, is provided, within which the conduit 11 is enclosed and supported on spaced props or slip supports 46 to permit of expansion and contraction due to temperature variation under operating and non-operating conditions, especially if handling gaseous cryogenic (LNG) material or vapors of such materials. The pipes 22 and 28 and the drain pipe 35 are also disposed within the pipe 45, and extend beyond the mound 40 with spaced props or slip supports 47.

The length of the buried pipe 45 is determined by the size of the flare and the flow rate which are factors influencing thermal radiation. The combustion, with a stack 10 extending about 12 feet above the mound 40 will produce a surrounding high radiation zone which may range from 10,000 to 30,000 BTU per hour per square foot, and provide equilibrium surface temperatures at the exposed surface of the mound 40 below the top of the stack of the order of 800° to 900° F.

On FIG. 1, the line L1 indicates a location at which the radiation is of the order of 3,000 BTU per hour per square foot, which is safe for carbon steel, and the line L2 indicates a location at which the radiation is of the order of 1500 BTU per hour per square foot which is considered safe for personnel.

The mode of operation should be clear from the foregoing but will be summarized briefly.

Waste combustible gas is supplied to and through the supply conduit 11 and through the flare stack 10 for burning at and beyond the upper or burner end 16. The pilots 15, if in operation, will ignite the gas from the burner end of the stack 10 and if the pilots 15 have been extinguished are lit by the flame front supplied through the ignitor pipes 22, 21, the divider ring 26 and the ignitor pipe 25. The flame will be protected by the windshield 13.

As the waste gas is burned the radiant heat is effective downwardly to the mound 40 which protects the portions of the pipe 10 enclosed therein, and the supply conduit 11, as well as the enclosed portions of the pipes 21, 22, 27, 28 and 35 against the destructive effect of the radiant heat from the flame. The exposed portions of the stack 10, the windshield 13, and the ignitor pilots 15 and the ignitor pipes 25 with their supply connections, as pointed out above, are made of heat resistant metal.

Provisions are also made for accommodating the expansion and contraction of the horizontally disposed conduit 11, and the pipes 22, 28 and 35 by their enclosure within the pipe 45 and their mounting for movement on supports 46 and 47.

The extension of the mound 40 to take into account the safe limit of their materials of construction also prevents any destructive action thereon by the radiant heat.

The provision of a mound 40 with an exterior surface of gravel or firebrick also immobilizes and permits burning upon contact directed away from the flare stack 10 by the peak **40*a*** of any liquid spills which may occur from the waste combustible gas or from the flame.

I claim:

1. Apparatus for combustion of waste gas comprising
a source of combustible waste gas,
a fixed base,
an upright flare stack pipe secured at its lower end to said base for combustion of said waste gas at its discharge end,
a protective conduit extending horizontally from the lower end of said stack pipe,
a generally horizontally disposed supply conduit connected to said source and rigidly secured to the lower end of said stack pipe for delivery of waste gas thereto from said source for combustion,
said supply conduit being disposed within said protective conduit,
a convexly shaped mound of heat reflective material of lower heat conductivity in surrounding and heat protective relation to the lower end of the stack pipe above the top of which said stack pipe extends,
said mound extending along a predetermined length of said protective conduit in heat protective relation thereto and to said supply conduit,
said supply conduit being supported within said protective conduit for expansion and contraction therein.

2. Apparatus as defined in claim 1 in which
the portions of said flare stack pipe extending above said mound are of heat resistant metal.

3. Apparatus as defined in claim 1 in which
an ignitor pilot is provided contiguous to the discharge end of the stack for igniting the combustible gas from said discharge end, and
supply connections are provided for said ignitor pilot having portions extending into and protected by said mound.

4. Apparatus as defined in claim 3 in which
an ignitor member is provided for said ignitor pilot, and
said ignitor member has activating connections extending into and protected by said mound.

5. Apparatus as defined in claim 1 in which
said mound has an exposed surface of broken pieces of non-combustible material to stabilize the exposed surface of the mound.

6. Apparatus as defined in claim 5 in which
said surface is of crushed stone.

7. Apparatus as defined in claim 5 in which
said surface is of pieces of firebrick.

8. Apparatus as defined in claim 1 in which
said mound is of sand.

9. Apparatus as defined in claim 1 in which
said mound is of dirt.

10. Apparatus as defined in claim 1 in which
said supply conduit is disposed within a protective conduit for expansion and contraction therein.

11. Apparatus as defined in claim 10 in which said supply connections for said ignitor pilots are disposed within said protective conduit.

12. Apparatus as defined in claim 1 in which said mound in covering relation to said supply conduit is of a horizontal length to protect said supply conduit against heat radiation from combustion at said discharge end of said stack.

13. Apparatus as defined in claim 10 in which said mound in covering relation to said protective conduit is of a horizontal length to protect said protective conduit and said supply conduit against heat radiation from combustion at said discharge end of said stack.

14. Apparatus as defined in claim 13 in which said supply connections for said pilot are disposed within said protective conduit.

* * * * *